US010344987B2

(12) United States Patent
Brakhage

(10) Patent No.: US 10,344,987 B2
(45) Date of Patent: Jul. 9, 2019

(54) SOUND-BASED FLAME MODULATION SYSTEM

(71) Applicant: Wheeldock, LLC, Stillwater, OK (US)

(72) Inventor: Rodney Dean Brakhage, Stillwater, OK (US)

( * ) Notice: Subject to any disclaimer, the term of this patent is extended or adjusted under 35 U.S.C. 154(b) by 182 days.

(21) Appl. No.: 15/643,756

(22) Filed: Jul. 7, 2017

(65) Prior Publication Data

US 2018/0010807 A1 Jan. 11, 2018

Related U.S. Application Data

(60) Provisional application No. 62/359,927, filed on Jul. 8, 2016.

(51) Int. Cl.

| | |
|---|---|
| ***F24C 15/06*** | (2006.01) |
| ***H04R 1/02*** | (2006.01) |
| ***H04R 1/34*** | (2006.01) |

(52) U.S. Cl.

CPC ..... *F24C 15/06* (2013.01); *H04R 1/025* (2013.01); *H04R 1/028* (2013.01); *H04R 1/345* (2013.01); *H04R 1/023* (2013.01)

(58) Field of Classification Search

CPC ... F24C 15/06; F24C 3/12; F24C 3/00; H04R 1/028; H04R 1/345; H04R 1/025; H04R 1/023; H04R 1/22; F23N 1/002; F23N 5/16

See application file for complete search history.

(56) References Cited

U.S. PATENT DOCUMENTS

| | | | | |
|---|---|---|---|---|
| 3,365,552 | A * | 1/1968 | Arnold | H04R 23/00 116/137 A |
| 3,407,273 | A * | 10/1968 | Arnold | H04R 23/00 116/137 A |
| 5,120,214 | A * | 6/1992 | West | F23N 5/16 431/12 |
| 9,301,042 | B2 * | 3/2016 | Akino | H04R 1/22 |
| 2010/0203460 | A1 * | 8/2010 | Formigoni | F23C 99/003 431/8 |
| 2010/0310997 | A1 * | 12/2010 | M gica Odriozola | F23N 1/002 431/8 |

FOREIGN PATENT DOCUMENTS

| | | |
|---|---|---|
| FR | 2689963 | * 10/1993 |

* cited by examiner

*Primary Examiner* — Alfred Basichas

(74) *Attorney, Agent, or Firm* — Dunlap Codding, P.C.

(57) ABSTRACT

A system may comprise a speaker in a speaker tube; a directional tube having a proximal end openly connected to the speaker tube; a first plate having an opening aligned with a distal end of the directional tube; a diaphragm in a spaced apart relationship with the first plate such that an air enclosure is formed between the diaphragm and the first plate, wherein the air enclosure, the directional tube, and the speaker tube cooperate to form a static-air space such that air pressure changes in the space produced by the at least one speaker move the diaphragm; a second plate in a spaced apart relationship with the diaphragm such that a gas enclosure is formed between the diaphragm and the second plate; wherein movement of the diaphragm moves gas in the gas enclosure through the second plate thereby modulating flames above the second plate when the gas is ignited.

20 Claims, 7 Drawing Sheets

SOUND-BASED FLAME MODULATION SYSTEM

CROSS-REFERENCE TO RELATED APPLICATION

This application claims priority to U.S. Provisional Application Ser. No. 62/359,927, filed on Jul. 8, 2016, the entire contents of which being hereby expressly incorporated herein by reference.

BACKGROUND

In the past, theatrical performances have used flames in conjunction with music to produce a dramatic effect. However, such theatrical flame effects have required the use of a pre-recorded sequence of timed triggers to coordinate the flames with the music or to punctuate the music with the flames. These pre-recorded sequences are time consuming and expensive to create. Additionally, some past systems have placed sound systems dangerously close to the source of the flames or the fuel for the flames. Since fuels such as propane and natural gas react to butyl rubber, which is common in speaker construction, there is a potential for fire and or explosions when the gas is in direct contact with the speakers.

Therefore, systems and methods are needed for more directly linking sound with the levels and/or volume of flames of a fire, while decreasing the risk of damage to the source of the sound and decreasing the risk of explosion.

SUMMARY

Systems and methods are disclosed to address the above problems, including a system comprising at least one speaker positioned in a speaker tube and having a cone with a concave surface externally orientated in relation to the speaker tube; at least one directional tube having a proximal end openly connected to the speaker tube; a first plate having an opening aligned with a distal end of the at least one directional tube; a diaphragm in a spaced apart relationship with the first plate such that an air enclosure is formed between the diaphragm and the first plate, wherein the air enclosure, the at least one directional tube, and the speaker tube cooperate to form a static-air space such that air pressure changes in the static-air space produced by the at least one speaker move the diaphragm; a second plate in a spaced apart relationship with the diaphragm such that a gas enclosure is formed between the diaphragm and the bottom of the second plate; and a one-way gas inlet port into the gas enclosure; wherein movement of the diaphragm moves gas in the gas enclosure through the through holes, thereby modulating flames above the top of the second plate when the gas from the through holes is ignited.

In one embodiment, a sound-based flame modulation system may comprise a speaker tube having a first end and a second end; a speaker positioned at least partially in the speaker tube proximate to the first end and having a cone with a concave surface orientated externally from the speaker tube; a directional tube having a proximal end and a distal end, the proximal end openly connected to the speaker tube between the first end and the second end of the speaker tube; a first plate having an opening aligned with the distal end of the directional tube such that a passageway is formed through the first plate; a diaphragm in a spaced apart relationship with the first plate such that an air enclosure is formed between the diaphragm and the first plate, wherein the air enclosure, the directional tube, and the speaker tube cooperate to form a static-air space such that air pressure changes in the static-air space produced by the speaker move the diaphragm; a second plate having a top, a bottom, and a plurality of through holes, in a spaced apart relationship with the diaphragm such that a gas enclosure is formed between the diaphragm and the bottom of the second plate wherein the air enclosure is isolated from the gas enclosure; and a one-way gas inlet port into the gas enclosure attachable to a source of a flammable gas; wherein movement of the diaphragm moves flammable gas in the gas enclosure through the through holes, thereby modulating flames above the top of the second plate when the flammable gas from the through holes is ignited. In one embodiment, at least one of a quantity and size of the plurality of through holes of the second plate may be based on a ratio of sound pressure to through hole pressure. In one embodiment, the system may further comprise one or more support positioned such that at least a portion of the diaphragm is biased toward the second plate

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function. In the drawings.

DETAILED DESCRIPTION OF EXEMPLARY EMBODIMENTS

Figure 1:
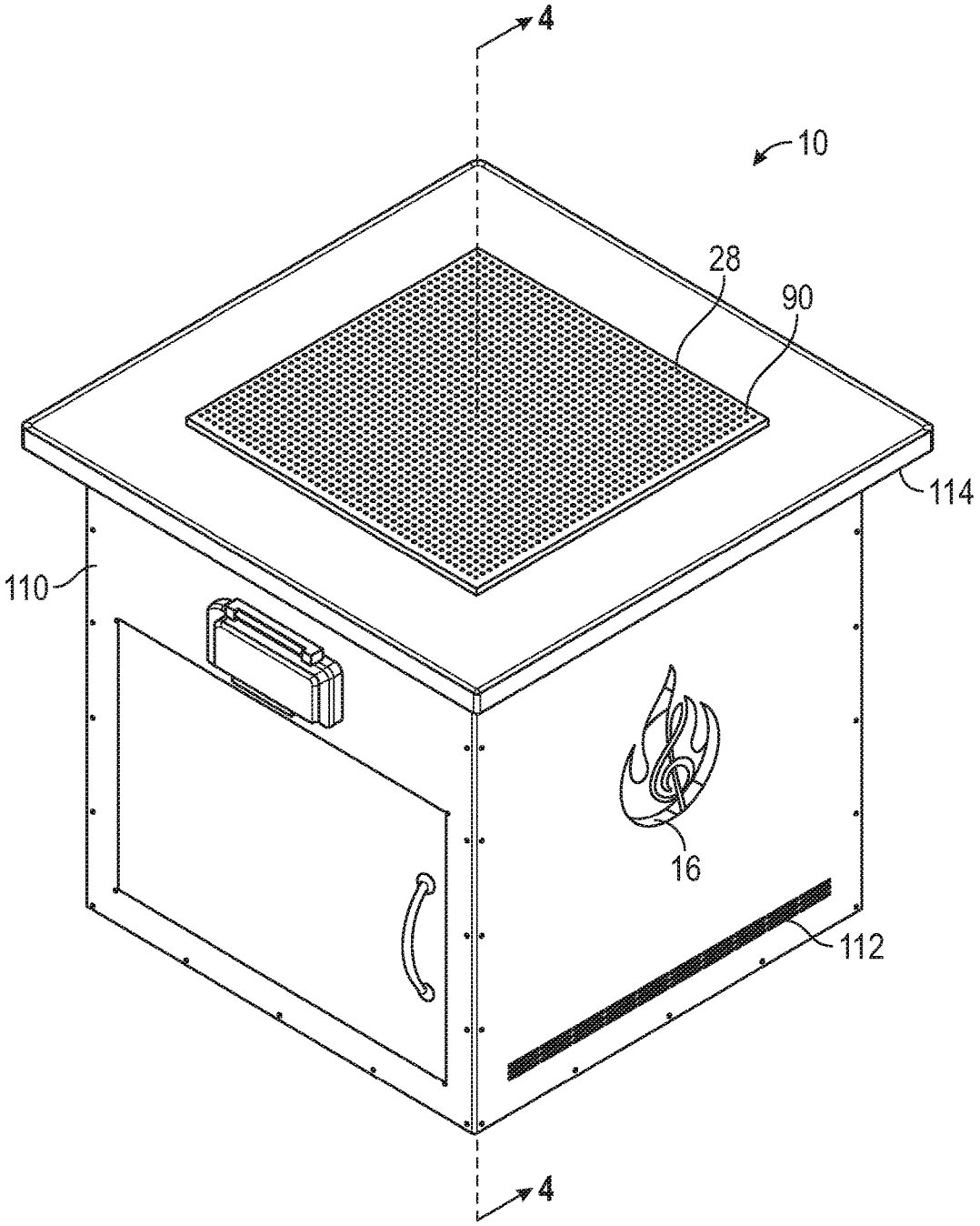
FIG. 1 is a perspective view of an exemplary embodiment of a sound-based flame modulation system in accordance with the present disclosure.
Figure 2:
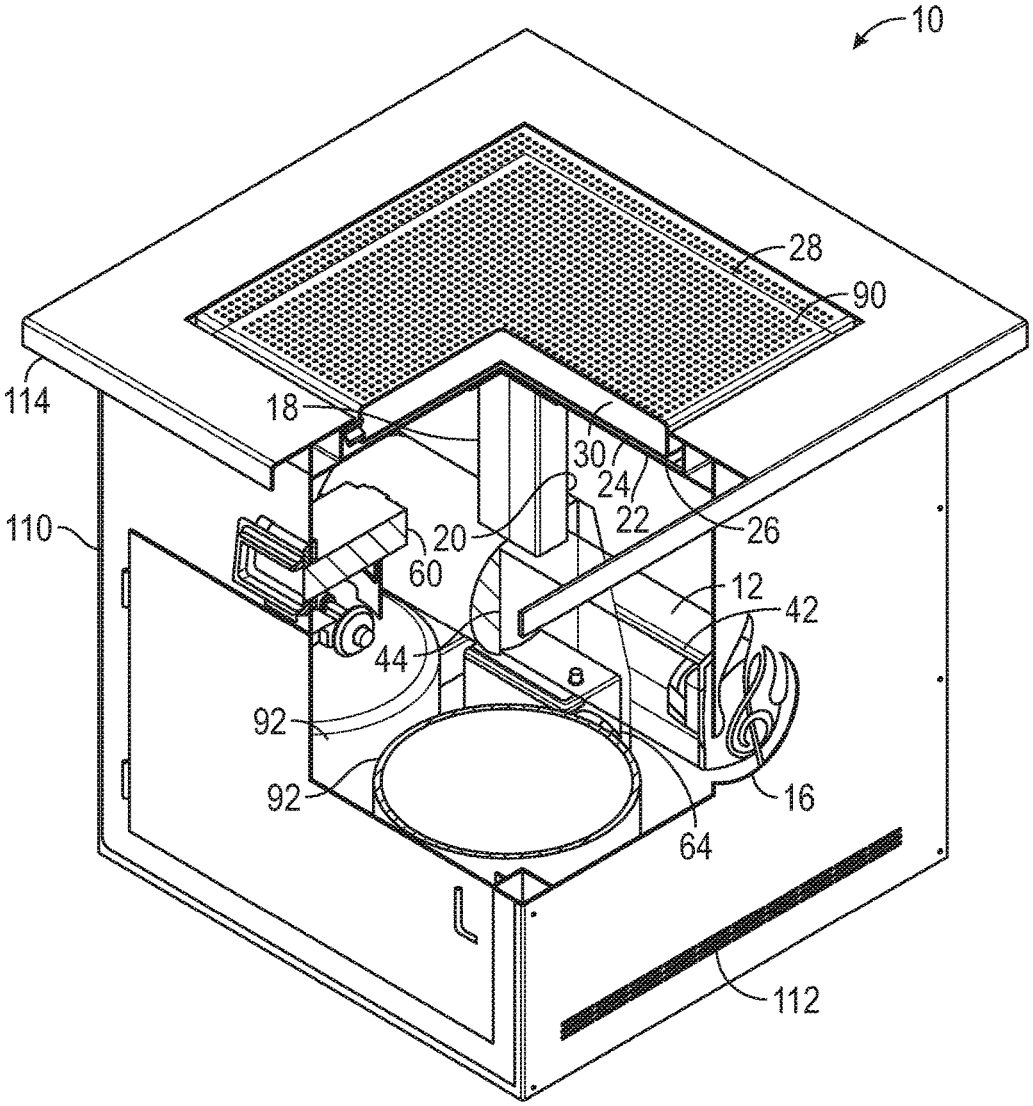
FIG. 2 is a perspective cut-out view of the sound-based flame modulation system of FIG. 1.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or"

refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more and the singular also includes the plural unless it is obvious that it is meant otherwise.

Further, use of the term "plurality" is meant to convey "more than one" unless expressly stated to the contrary.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

The use of the term "at least one" or "one or more" will be understood to include one as well as any quantity more than one. In addition, the use of the phrase "at least one of X, V, and Z" will be understood to include X alone, V alone, and Z alone, as well as any combination of X, V, and Z.

The use of ordinal number terminology (i.e., "first", "second", "third", "fourth", etc.) is solely for the purpose of differentiating between two or more items and, unless explicitly stated otherwise, is not meant to imply any sequence or order or importance to one item over another or any order of addition.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, FIGS. 1-9 illustrate an exemplary embodiment of a sound-based flame modulation system 10, comprising at least one speaker tube 12, a first speaker 14, a second speaker 16, a first directional tube 18, a second directional tube 20, a first plate 22, a diaphragm 24 in a spaced apart relationship with the first plate 22 forming an air enclosure 26 between the first plate 22 and the diaphragm 24, a second plate 28 in a spaced apart relationship with the diaphragm 24 forming a gas enclosure 30 between the diaphragm 24 and the second plate 28, and at least one one-way gas inlet port 32 into the gas enclosure 30. The speaker tube 12, the first directional tube 18, the second directional tube 20, and the air enclosure 26 may cooperate to form one or more static-air space 34 within the flame modulation system 10.

The speaker tube 12 may have a first end 40, a second end 42, and a wall 44 separating the first end 40 and the second end 42. The speaker tube 12 may be made of metal, plastic, wood, or other appropriate material for directing sound waves and vibration. The speaker tube 12 may be cylindrical in shape or may have one or more other geometric shape. The wall 44 may partially or completely separate the first end 40 from the second end 42.

In one embodiment, the first speaker 14 may be positioned at least partially in the speaker tube 12 proximate to the first end 40. The second speaker 16 may be positioned at least partially in the speaker tube 12 proximate to the second end 42. The first speaker 14 and the second speaker 16 may each have a cone 46 with a concave surface 48 orientated externally from the speaker tube 12 and a convex surface 50 orientated internally in relation to the speaker tube 12. The first and the second speakers 14, 16 produce sound waves, from both the concave surfaces 48 of the cones 46 and from the convex surfaces 50 of the cones 46 as the cones 46 are moved. The orientation of the cones 46 results in more sound waves being projected out of the speaker tube 12 than into the speaker tube 12.

In one embodiment the first speaker 14 and the second speaker 16 may each comprise a linear electric motor which uses a voice coil wound onto a form and energized with electrical current to push and pull the speaker cone 46 to create sound waves.

Typically, there may be substantially equal force pushing the speaker cone 46 as pulling the speaker cone 46. This back-and-forth movement of the speaker cones 46 in the speaker tube 12 may create positive and negative air pressure, respectively, in the static-air space 34.

In one embodiment, the first speaker 14 and/or the second speaker 16 are rated as marine-grade speakers that are designed for outdoor use and resistant to water.

Figure 4:
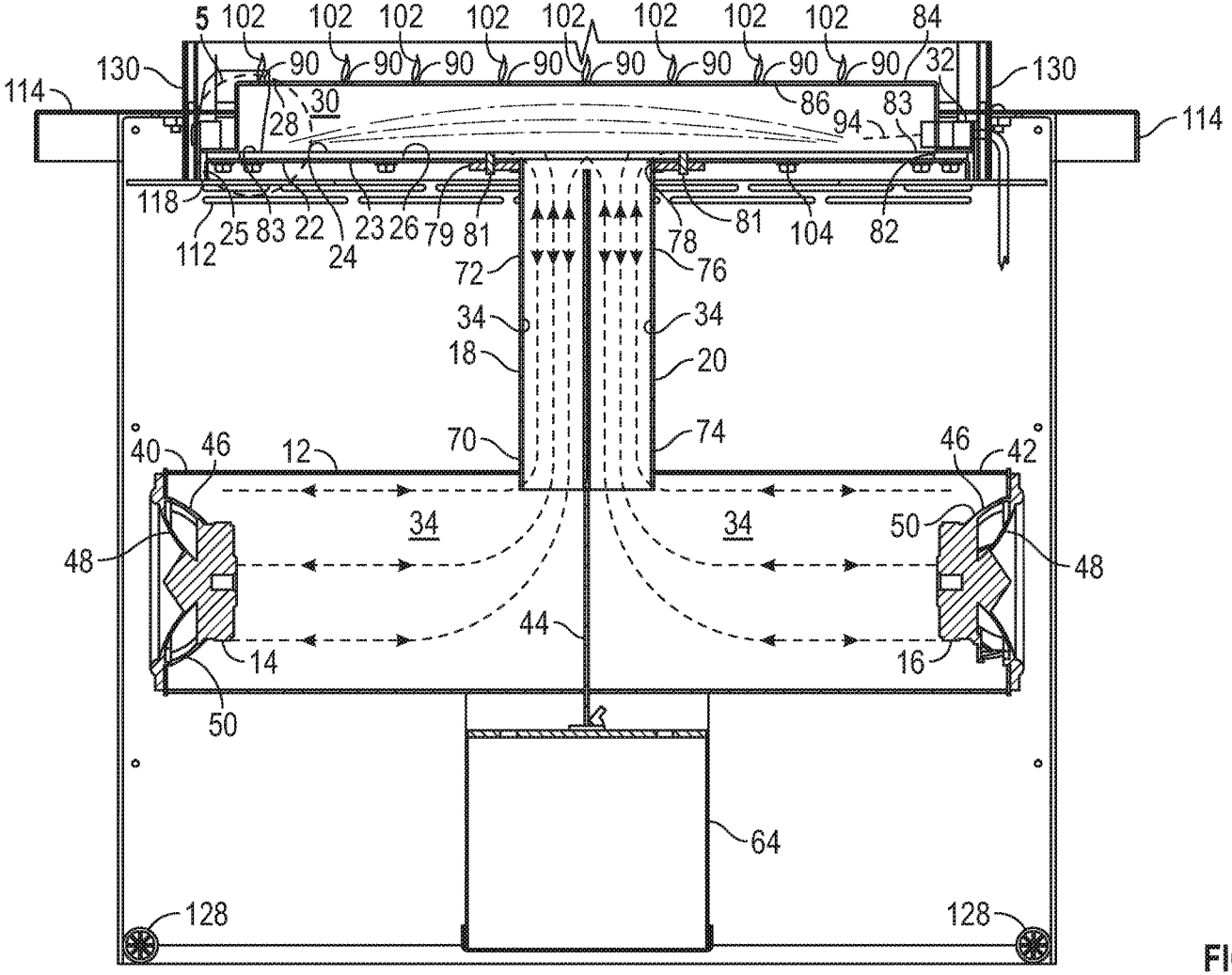
FIG. 4 is a cross-sectional view of components of the sound-based flame modulation system taken along line 4-4 of FIG. 1.

As illustrated in FIG. 4, when the first speaker 14 or the second speaker 16 receives audio signals, movement of the cone 46 moves air particles positioned around the cone 46 away from the cone 46. Those air particles in turn move the air particles around them, carrying the pulse of the vibration through the air as a traveling disturbance (also known as sound waves). Movement in a first direction pushes the surrounding air particles (creating positive pressure in the static-air space 34), and then movement away from the first direction pulls on the surrounding air particles, creating a drop in pressure that pulls in more surrounding air particles, which creates another drop in pressure that pulls in particles that are even farther out, and so on (creating negative pressure in the static-air space 34). In this way, the first speaker 14 and/or second speaker 16 send waves of pressure fluctuation through the static-air space 34 from the convex surface 50 of the cone 46, and the atmosphere from the concave surface 48 of the cone 46, which is interpreted by the human ear as sound.

A higher sound wave frequency means that the air pressure fluctuates faster (which is heard as a higher pitch). A lower sound wave frequency means that the air pressure fluctuates more slowly (which is heard as a lower pitch). Air-pressure level correlates to the sound wave's amplitude, which determines how loud the sound is. Sound waves with greater amplitudes are heard as louder sounds.

Though the flame modulation system 10 is described as having two speakers 14, 16, the flame modulation system 10 may have other numbers of speakers. For example, the flame modulation system 10 may have one speaker, three speakers, four speakers, five speakers, and so on.

The first speaker 14 and the second speaker 16 are connected to at least one audio signals source 60. The connection may be wired or wireless. The audio signals source 60 may include, but is not limited to, a stereo, a radio, a computer, a portable computing device, a smart phone, a portable music device, and/or a microphone. For explanatory purposes, the audio signals source 60 is shown in the figures as a stereo connected with wires 62 to the first speaker 14 and the second speaker 16. It will be understood that the audio signals source 60 may be separate from the flame modulation system 10 and/or located in one or more different locations than the other components of the flame modulation system 10.

Figure 3:
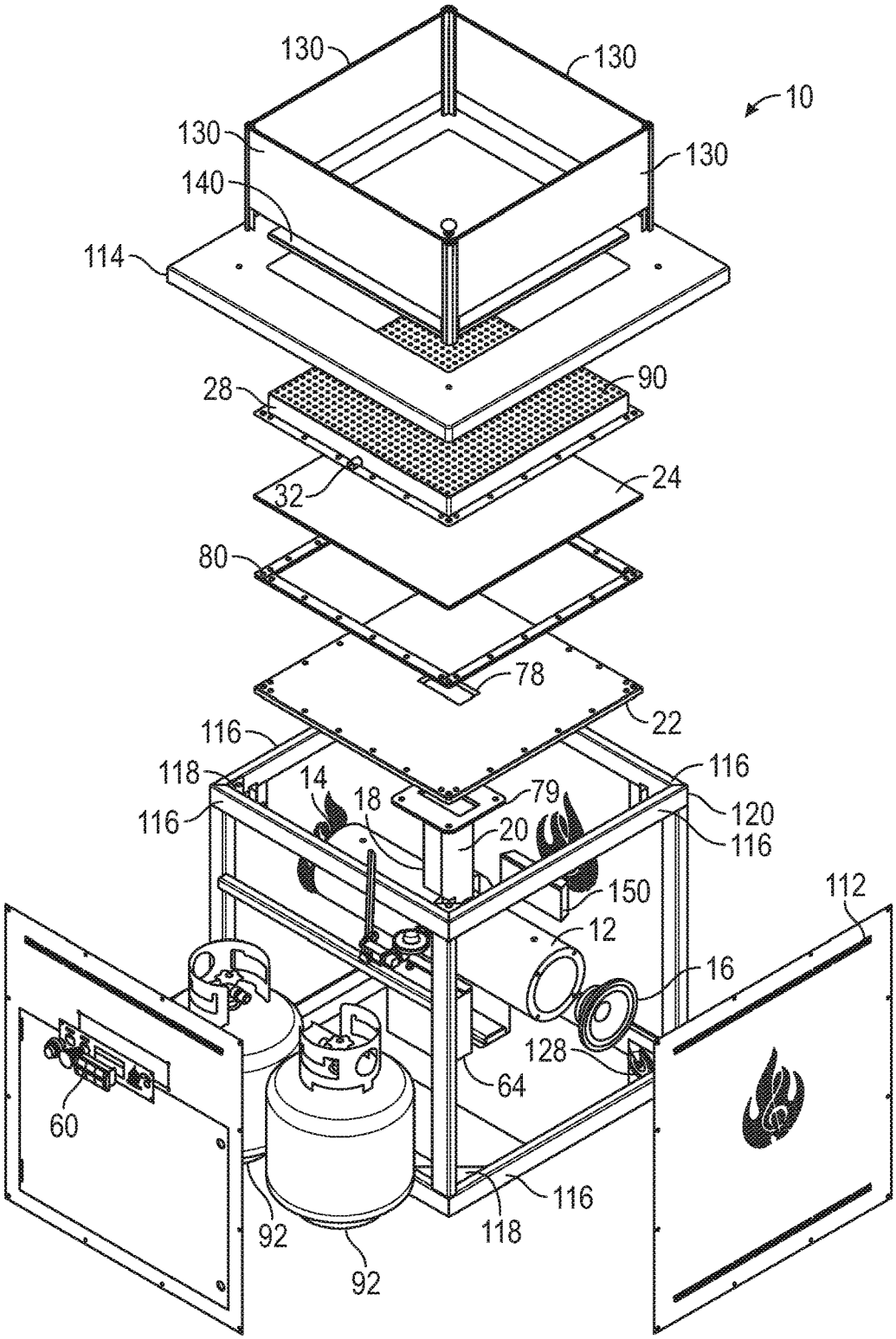
FIG. 3 is an exploded, perspective view of components of an exemplary embodiment of a sound-based flame modulation system in accordance with the present disclosure.

As shown in FIG. 3, in one embodiment, the flame modulation system 10 may further include one or more electrical power source 64. One nonexclusive example of the electrical power source 64 is a battery and/or a rechargeable battery. The electrical power source 64 may be connected with wires 66 to the audio signals source 60, for example, to the stereo, and/or the first speaker 14 and/or the second speaker 16. Alternately, or additionally, the flame modulation system 10 may be connected to an external electrical power source (not shown).

As shown in FIG. 4, in one embodiment, the first directional tube 18 may have a proximal end 70 and a distal end 72, the proximal end 70 openly connected to the speaker tube 12 between the first end 40 and the wall 44 of the speaker tube 12. The second directional tube 20 may have a proximal end 74 and a distal end 76, the proximal end 74 openly connected to the speaker tube 12 between the wall 44 and the second end 42 of the speaker tube 12.

Though the flame modulation system 10 is described as having two directional tubes 18, 20, the flame modulation system 10 may have a different number of directional tubes. For example, the flame modulation system 10 may have one directional tube, three directional tubes, four directional tubes, five directional tubes, and so on.

The first plate 22 may have an opening 78 aligned with the distal ends 72, 76 of the first directional tube 18 and the second directional tube 20 such that air pressure fluctuations (i.e., sound waves) travel through the speaker tube 12, the first and the second directional tubes 18, 20, the first plate 22, and the air enclosure 26 (i.e. through the static-air space 34) to the diaphragm 24.

In one embodiment, the flame modulation system 10 may further comprise an adaptor plate 79 positioned beneath the first plate 22 and having an opening aligned with the opening 78 of the first plate 22 and aligned with the distal ends 72, 76 of the first directional tube 18 and the second directional tube 20.

In one embodiment, the first plate 22 may be in the shape of a pan, the first plate 22 having a center portion 23 and a lip 25.

As previously described, the diaphragm 24 is in a spaced apart relationship with the first plate 22 such that the air enclosure 26 is formed between the diaphragm 24 and the first plate 22. In one embodiment, the flame modulation system 10 includes a spacer 80 between the diaphragm 24 and the first plate 22. In one embodiment, the spacer 80 may be shaped as a frame having an interior surface 82 that, along with the diaphragm 24 and the first plate 22, defines the air enclosure 26.

In one embodiment, the flame modulation system 10 may further comprise one or more support 81 between the first plate 22 and the diaphragm 24. The one or more support 81 may be positioned such that the diaphragm 24 is concave in relation to the first plate 22 and the air enclosure 26. In one embodiment, the one or more support 81 may be positioned such that the diaphragm 24 has one or more high point relative to side portions 83 of the diaphragm 24. The one or more support 81 may be positioned such that the diaphragm 24 has one or more high points that are approximately one eighth of one inch higher than the side portions 83 of the diaphragm 24 relative to the first plate 22. In one embodiment, the one or more support 81 may be one or more fastener positioned through the adaptor plate 79. In one embodiment, the one or more support 81 may be a first fastener positioned through a first side of the adaptor plate 79 and a second fastener positioned through a second side of the adaptor plate 79.

The one or more support 81 may force the diaphragm 24 to expand in an upward direction (away from the one or more support 81 and the first plate 22) when the diaphragm 24 is heated. The one or more support 81 may prevent the diaphragm 24 from contacting the first plate 22; as such contact of the diaphragm 24 with the first plate 22 may cause an undesirable noise.

The diaphragm 24 may act as a passive radiator that further generates sound waves. The diaphragm 24 may be made of a suitably flexible and/or expandable material. In one embodiment, the diaphragm 24 may be fabricated from stainless steel, such as SAE 304 stainless steel.

The positive and negative air pressure generated by the first speaker 14 and the second speaker 16 within the static-air space 34 pulls and pushes the diaphragm 24, effectively doubling the movement of the diaphragm 24 since there is a pulling effect on the diaphragm 24 cycling with a pushing effect on the diaphragm 24.

Cancellation or muting of sound waves (i.e. air pressure fluctuations) due to interference from other sound waves would reduce the amount of movement of the diaphragm 24. Therefore, the wall 44 of the speaker tube 12 may separate the sound waves from the first speaker 14 and the sound waves from the second speaker 16, thus preventing sound waves from the first speaker 14 from cancelling or muting sound waves from the second speaker 16, and vice versa.

The second plate 28 has a top 84 and a bottom 86. As previously described, the second plate 28 is in a spaced apart relationship with the diaphragm 24 such that a gas enclosure 30 is formed between the diaphragm 24 and the bottom 86 of the second plate 28. In one embodiment, the second plate 28 is shaped to partially form the gas enclosure 30. For example, the second plate 28 may be shaped as a pan with a side 87 extending around a center portion 88. In one embodiment, the second plate 28 may have a lip 89 extending from the side 87.

The second plate 28 has a plurality of through holes 90. In one embodiment, the second plate 28 has more than 100 through holes 90. In one embodiment, the second plate 28 has more than 1,000 through holes 90. In one embodiment, the second plate 28 has between 1,000 and 2,000 through holes 90. In one embodiment, the second plate 28 has approximately 1,200 through holes 90. In one embodiment, the second plate 28 has approximately 1,600 through holes 90.

In one embodiment, the size, shape, and/or quantity of the through holes 90 of the second plate 28 may be based at least in part on a desired predetermined volumetric flow rate and sensitivity of flow rate changes of the flammable gas 94 through the through holes 90.

A ratio of sound pressure to through hole pressure may be used as at least part of the determination of the volumetric flow rate and sensitivity of flow rate changes of the flammable gas 94 through the through holes 90. As used herein, the term sound pressure means the pressure in the gas enclosure 30 created by the sound waves from the speaker(s) 14, 16 moving through the air enclosure 26 that move the diaphragm 24 within the gas enclosure 30, producing more or less pressure on the flammable gas 94 in the gas enclosure 30. The sound pressure may also include the gas source pressure. As used herein, the term gas source pressure means the resulting pressure within the gas enclosure 30 caused by the input of the flammable gas 94 from the source 92 into the gas enclosure 30. As used herein, the term through hole pressure means the pressure required to force the flammable gas 94 through the through holes 90.

In other words, the size, shape, and/or quantity of through holes 90, the volume of the gas enclosure 30 (which affects the pressure in the gas enclosure 30), the supply and/or flow rate of flammable gas 94 from the source 92 (comprising volume and/or pressure and which may be controlled by the regulator 122), and/or the sound pressure may be used to control how much of, and how fast, the flammable gas 94 moves through the second plate 28 and how much pressure is needed to change the volume of flammable gas 94 moving through the second plate 94 as sound pressure is applied to the diaphragm 24.

In one embodiment, the size, shape, and/or quantity of through holes 90, the volume of the gas enclosure 30 (which affects the pressure in the gas enclosure), the supply and/or flow rate of flammable gas 94 from the source 92 (comprising volume and/or pressure and which may be controlled by the regulator 122), and/or the sound pressure may be sized and controlled to result in the flammable gas 94 moving through the through hole 90 at a velocity that produces a flame 102 that is tight (not diffuse) and that produces a modulation of the volume of the flame 102 at low sound pressure (such as that caused by low music volumes and/or music without much content with lower sound wave frequency) that is discernible by the user.

When the ratio of sound pressure to through hole pressure is above a desired range, excess flammable gas 94 may pass through the through holes 90, causing undesirable amounts of uncombusted flammable gas 94 above the second plate 28, as well as less of a change in height of flames 102 caused by the change in sound waves. For example, changes at a low volume or low frequency of sound waves may not be apparent in the resulting height of the flames 102. When the ratio of sound pressure to through hole pressure is below a desired range, flammable gas 94 may collect in the gas enclosure 30, causing an undesirable pressure and amount of flammable gas 94 in the gas enclosure 30, resulting in smaller flames 102 and less sensitivity of the size of the flames 102 to changes in sound pressure.

In one embodiment, one or more of the through holes 90 of the second plate 28 may have a diameter between 0.020 and 0.060 inch. In one embodiment, one or more of the through holes 90 may have a diameter of approximately 0.035 inch.

In one embodiment, the second plate 28 may be a cooking surface. In one embodiment, the flame modulation system 10 includes a grill (not shown) positioned above the second plate 28. The grill may be used as a cooking surface.

The one-way gas inlet port 32 into the gas enclosure 30 is attachable to a source 92 of a flammable gas 94. Non-exclusive examples of flammable gas 94 include natural gas or propane. The gas inlet port 32 may have a control device 95 that, when activated, reduces, increases, or blocks the flammable gas 94 moving into the gas enclosure 30. In one embodiment, pressure from the source 92 of the flammable gas 94 may push a steady amount of flammable gas 94 out of the gas enclosure 30 through the through holes 90 of the second plate 28.

In one embodiment, one or more of the through holes 90 of the second plate 28 may have a diameter of approximately 0.035 inch and the source 92 of flammable gas 94 may provide approximately 77,000 BTUs, where BTU is a measurement of the maximum output of the source 92 of the flammable gas 94.

The air enclosure 26, and the static-air space 34, are isolated from the gas enclosure 30 such that gas 94 in the gas enclosure 30 does not enter the air enclosure 26 or the static-air space 34 and does not come into contact with the first speaker 14 or the second speaker 16.

Figure 5:
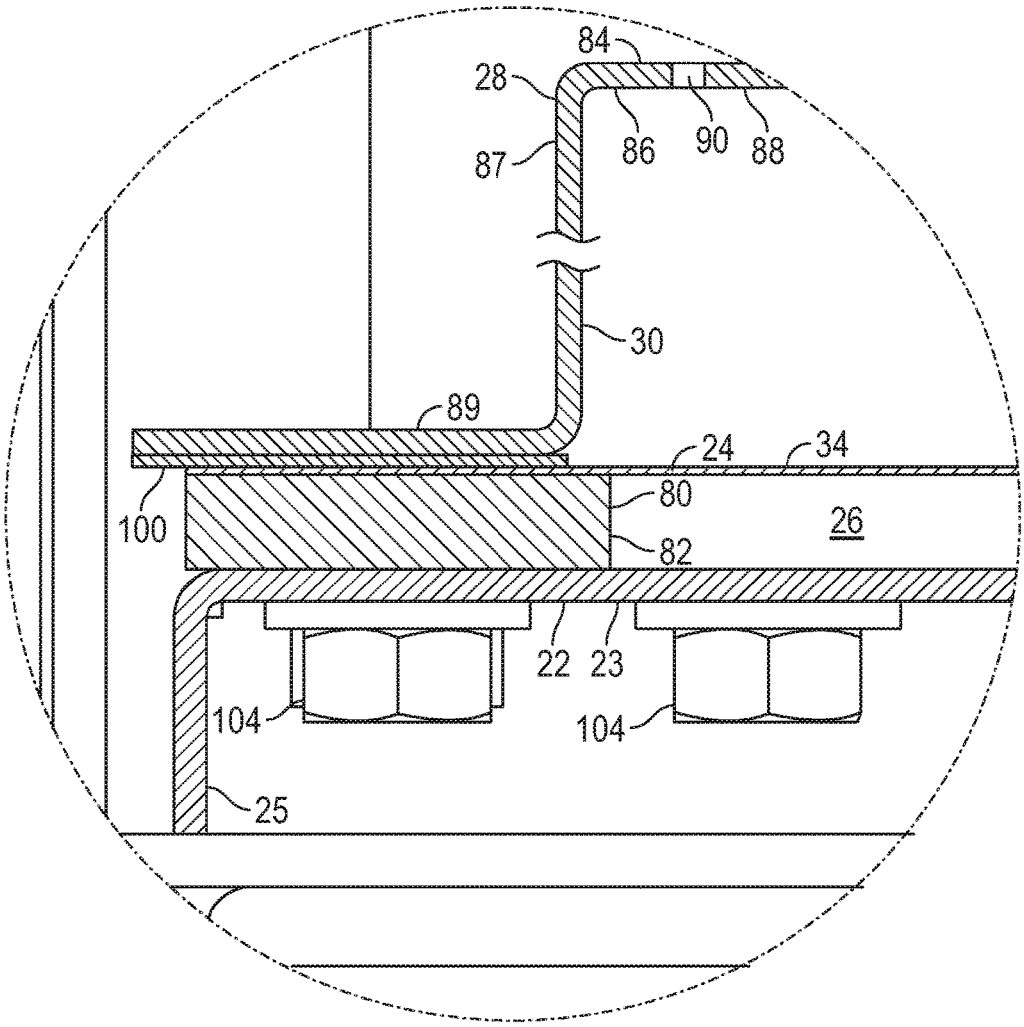
FIG. 5 is a detail view of a portion of FIG. 4.
Figure 6:
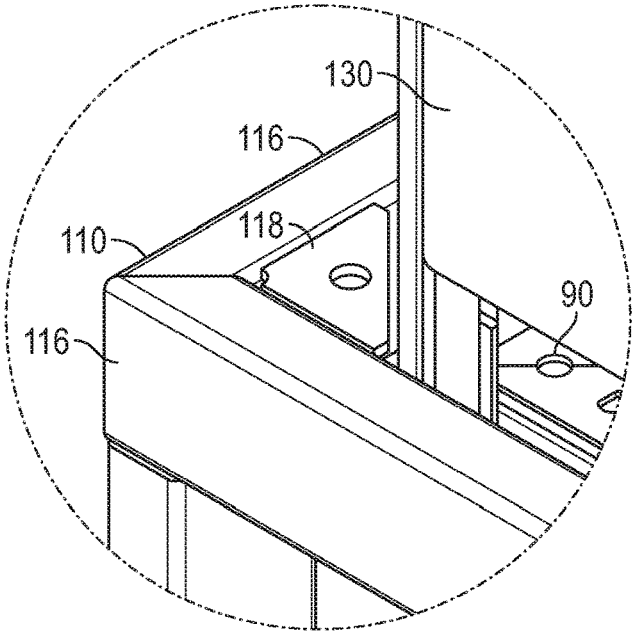
FIG. 6 is a detail view of components of an exemplary embodiment of a sound-based flame modulation system in accordance with the present disclosure.
Figure 7:
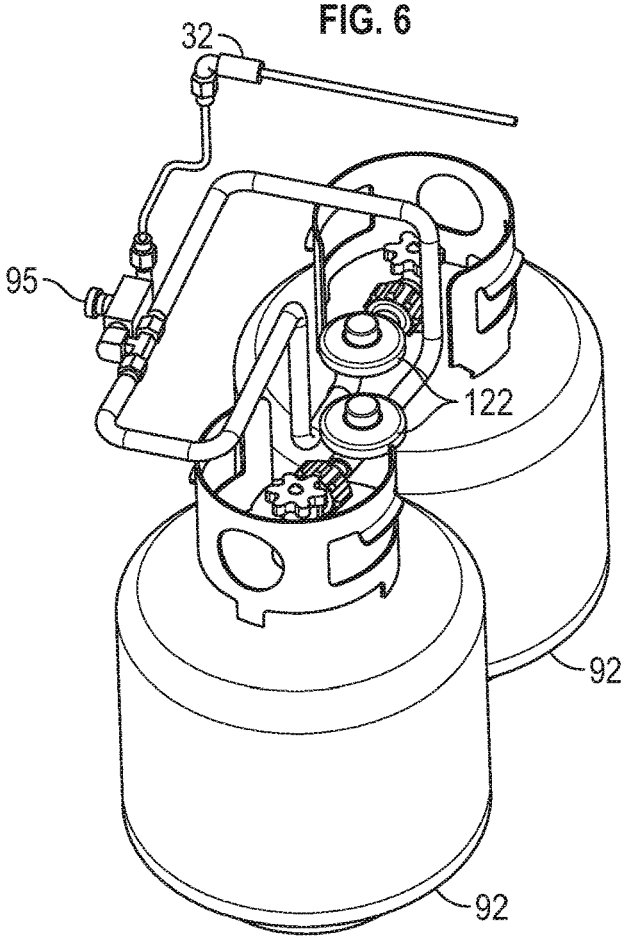
FIG. 7 is a perspective view of components of the sound-based flame modulation system of FIG. 1.
Figure 8:
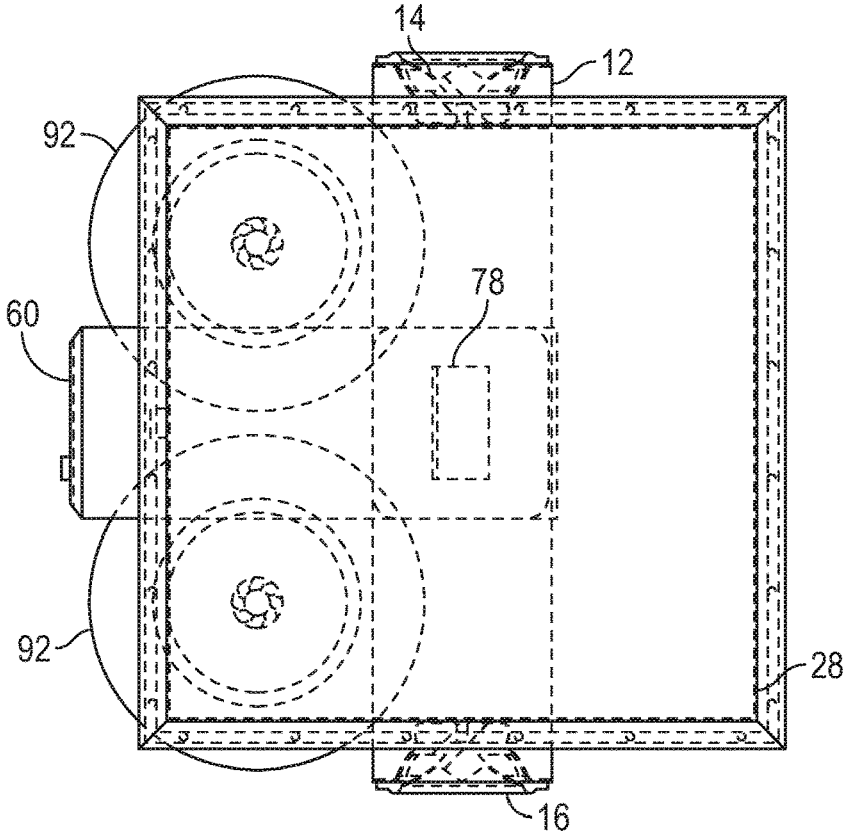
FIG. 8 is a top plan schematic view of components of the sound-based flame modulation system of FIG. 1.
Figure 9:
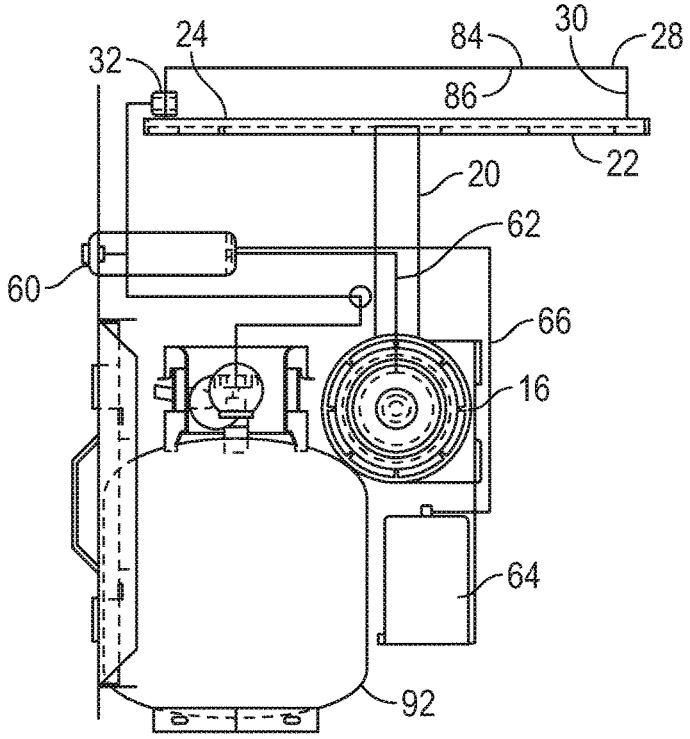
FIG. 9 is a side elevational schematic view of components of the sound-based flame modulation system of FIG. 1.

As shown in FIG. 5, in one embodiment, the flame modulation system 10 may include one or more seal 100 to further isolate the air enclosure 26 and the static-air space 34 from the gas enclosure 30. In one embodiment, the seal 100 may be positioned between the second plate 28 and the diaphragm 24. In one embodiment, the seal 100 may be positioned between the lip 89 of the second plate 28 and the diaphragm 24. The one or more seal 100 may be one or more gasket, o-ring, strip, formed elastomer, or other gas-impermeable device and/or material. In one embodiment, the one or more seal 100 may be a temperature resistant silicone gasket strip.

In one embodiment, the flame modulation system 10 may further comprise one or more fasteners 104. The one or more fasteners 104 may be positioned to connect one or more of the first plate 22, the diaphragm 24, and the second plate 28.

The movements of the diaphragm 24 push the gas 94 in the gas enclosure 30 out of the through holes 90 of the second plate 28. The gas 94 may be ignited above the top 84 of the second plate 28 such that flames 102 are produced.

As the sound waves (i.e. the air pressure fluctuations) produced by the first and/or the second speakers 14, 16 change in amplitude and frequency, the movements of the diaphragm 24 also change in amplitude and frequency. The changes in the movements of the diaphragm 24 changes the amount of gas 94 pushed out of the through holes 90 of the second plate 28, which changes the volume and height of the flames 102 on the top 84 of the second plate 28. Thus, the amplitude and frequency of sound from the first and/or the second speakers 14, 16 modulates the volume and height of the flames 102.

The amount of, and sensitivity of changes in, modulation of the volume and height of the flames 102 may be based at least in part on the ratio of sound pressure to gas pressure and/or the size, shape, and/or quantity of through holes 90. In one embodiment, the size, shape, and/or quantity of through holes 90 is based at least in part on the effect on the amount of, and sensitivity of changes in, modulation of the volume and height of the flames 102. In one embodiment, the size, shape, and/or quantity of through holes 90 is determined so as to create a high sensitivity to changes in modulation of the volume and height of the flames, so that when the sound pressure is low and the changes in sound pressure are accordingly small (for example, when music is played at low volume, and/or music is played with mid and high frequencies with little bass frequencies, through the speakers 14, 16), the modulations of the volume and height of the flames 102 are still visible to the user.

Since the positive and negative air pressure generated by the first speaker 14 and the second speaker 16 within the static-air space 34 pulls and pushes the diaphragm 24, effectively doubling the movement of the diaphragm 24, the amount of gas 94 pushed out of the through holes 90 of the second plate 28 is also effectively doubled.

Additionally, the movements of the diaphragm 24 may produce sound that may move out of the through holes 90 of the second plate 28.

In one embodiment, the flame modulation system 10 may include a housing 110 encompassing one or more of the other components of the flame modulation system 10. The housing 110 may have vents 112 and may be constructed in accordance with safety regulations.

In one embodiment, the housing 110 may include an apron 114 positioned about the second plate 28.

In one embodiment, the housing 110 may be substantially thermally isolated from the components of the flame modulation system 10 that are heated. The housing 110 may be substantially thermally isolated from the first plate 22, the diaphragm 24, and the second plate 28.

In one embodiment, the housing 110 may have one or more frame member 116 and one or more gusset 118 attachable to the frame members 116, such as attachable to the frame members 116 at junctions of the frame members 116. In one embodiment, the housing 110 may have a top portion 120 and four upper substantially horizontal frame members 116 positioned proximate to the top portion 120. The housing 110 may have four gussets 118, with one gusset 118 at each junction of the upper substantially horizontal frame members 116.

In one embodiment, the first plate 22 may be at least partially supported by contact with the one or more gusset 118. The one or more gusset 118 may thermally isolate the first plate 22, the diaphragm 24, and the second plate 28 from the housing 110. In one embodiment, the flame modulation system 10 may comprise thermally insulating materials between the first plate 22 and the one or more gusset 118 and/or the housing 110.

In one embodiment, the source 92 of the flammable gas 94 may be positioned within the housing 110. For example, the source 92 of the flammable gas 94 may be one or more propane canister positioned within the housing 110 and attached to the one-way gas inlet port 32. Of course, it will be understood that the source 92 of the flammable gas 94 may be external to the housing 110 and/or the flame modulation system 10.

When the source 92 of the flammable gas 94, such as one or more propane canister, is included in the flame modulation system 10, electrical components and/or other components included in the flame modulation system 10 may comply with standards for components located in explosive environments. Non-exclusive examples of such standards include standards and codes developed by the American Petroleum Institute, the National Fire Protection Association standard (for example, NFPA 57, 2002 edition, NFPA 70, and/or NFPA54), the Canadian Standards Association, and the International Electrotechnical Commission. The components and/or the flame modulation system 10 may also conform to one or more other codes such as the National Fuel Gas Code (ANSI Z223.1), the Propane Storage and Handling Code (CSA B149.2), the Standard for Recreational Vehicles (ANSI A 119.2/NFPA 1192), and/or the Recreational Vehicle Code (CSA Z240 RV Series).

In one embodiment, the flame modulation system 10 may comprise one or more pressure regulator 122. The pressure regulator 122 may regulate the pressure of the flammable gas 94 from the source 92 of the flammable gas 94.

In one embodiment, the flame modulation system 10 may be inserted into a fire pit, a grilling station, an entertainment unit, a fire place insert, or other system in which sound-based flame modulation is desirable.

In one embodiment, the flame modulation system 10 includes one or more wheels 128 such that the flame modulation system 10 is portable.

In one embodiment, the flame modulation system 10 may further comprise one or more panel 130. The one or more panel 130 may be positioned around the second plate 28. In one embodiment, the one or more panel 130 may be substantially vertical. In one embodiment, the one or more panel 130 may be attachable to the apron 114 and/or the housing 110. In one embodiment, the one or more panel 130 may be made of a substantially transparent and heat resistant material, such as tempered glass. The one or more panel 130 may provide a barrier that substantially blocks or reduces wind gusts from directly reaching the second plate 28 and the flames 102. Additionally the one or more panel 130 may provide a physical barrier between the users and the flames 102.

In one embodiment, the flame modulation system 10 may comprise one or more lid 140. The lid 140 may be sized to cover the second plate 28 when the flame modulation system 10 is not in use, such that the through holes 90 are protected from dirt and/or moisture.

In one embodiment, the flame modulation system 10 may comprise one or more audio signal amplifier 150.

Turning to FIG. 4, an example of one embodiment of the flame modulation system 10 in use in accordance with the present disclosure will be described. A user may activate the electrical power source 64, such as a battery, a hard-wired switch connecting the flame modulation system 10 to a power source, or a plug into an electrical outlet, and turn on the audio signals source 60 to activate the first speaker 14 and the second speaker 16. The user may begin flow of the gas 94 through the one-way gas inlet port 32 into the gas enclosure 30.

Movement of the cone 46 of the first speaker 14 generates sound waves (i.e. pressure changes) in the surrounding air. The sound waves travel away from the concave surface 48 of the cone 46 of the first speaker 14 into the surrounding air and away from the convex surface 50 of the cone 46 of the first speaker 14 into the static-air space 34 within the speaker tube 12. The sound waves travel through the speaker tube 12, the first directional tube 18, and the opening 78 of the first plate 22 into the air enclosure 26 (i.e., through the static-air space 34), creating positive and negative pressure through the static-air space 34. The positive pressure and negative pressure act on the diaphragm 24 resulting in movement of the diaphragm 24, such as expansion of the diaphragm 24 toward the air enclosure 26 (negative pressure) or into the gas enclosure 30 (positive pressure).

Likewise, movement of the cone 46 of the second speaker 16 generates sound waves in the surrounding air. The sound waves travel away from the concave surface 48 of the cone 46 of the second speaker 16 into the surrounding air and away from the convex surface 50 of the cone 46 of the second speaker 16 into the static-air space 34 within the speaker tube 12. The sound waves travel through the speaker tube 12, the second directional tube 20, and the opening 78 of the first plate 22 into the air enclosure 26 (i.e., through the static-air space 34), creating positive and negative pressure through the static-air space 34. The positive pressure and negative pressure act on the diaphragm 24 resulting in movement of the diaphragm 24, such as expansion of the diaphragm 24 toward the air enclosure 26 (negative pressure) or into the gas enclosure 30 (positive pressure).

The movement and/or expansion of the diaphragm 24 into the gas enclosure 30 pushes the gas 94 in the gas enclosure 30 out of the through holes 90 of the second plate 28 in time with, and correlated to the intensity of, the sound waves from the first speaker 14 and the second speaker 16.

The gas 94, now above the top 84 of the second plate 28, is ignited to produce the flames 102. The flames 102 are modulated (for example, increase and decrease in intensity and volume) in conjunction with the movement of the diaphragm 24, which is correlated with the sound waves from the first and second speakers 14, 16.

Movement of the diaphragm 24 within the gas enclosure 30 creates a rapidly changing volume of flammable gas 94 in the gas enclosure 30 by forcing the flammable gas 94 out of the gas enclosure 30 via the through holes 90.

Higher sound wave frequencies from the first speaker 14 and/or the second speaker 16 means that the air pressure in the static-air space 34 fluctuates faster, moving the diaphragm 24 faster, thus fluctuating the height of the flames 102 more quickly. Lower sound wave frequencies from the first speaker 14 and/or the second speaker 16 means that the air pressure in the static-air space 34 fluctuates more slowly, moving the diaphragm 24 more slowly, thus fluctuating the height of the flames 102 more slowly.

Louder sounds from the first speaker 14 and/or the second speaker 16 increase the air-pressure in the static-air space 34, increasing the movement of the diaphragm 24, thus forcing the diaphragm 24 further into the gas enclosure 30, forcing more gas 94 out of the through holes 90 of the second plate 28 and causing the flames 102 to flare higher. Quieter sounds from the first speaker 14 and/or the second speaker 16 have less of an increase in, or even produce a decrease of, the air-pressure in the static-air space 34, thus pushing the diaphragm 24 a lesser amount into the gas enclosure 30, which forces less (or no) gas 94 out of the through holes 90 of the second plate 28 and decreases the height and/or intensity of the flames 102.

While several embodiments of the inventive concepts have been described for purposes of this disclosure, it will be understood that numerous changes may be made which will readily suggest themselves to those skilled in the art and which are accomplished within the spirit of the inventive concepts disclosed and as defined in the appended claims.

CONCLUSION

Conventionally, coordinating sound with flame effects has been a time intensive and/or dangerous endeavor. In accordance with the present disclosure, these problems are addressed with systems and methods for sound-based flame modulation.

The foregoing description provides illustration and description, but is not intended to be exhaustive or to limit the inventive concepts to the precise form disclosed. Modifications and variations are possible in light of the above teachings or may be acquired from practice of the methodologies set forth in the present disclosure.

Even though particular combinations of features are recited in the claims and/or disclosed in the specification, these combinations are not intended to limit the disclosure. In fact, many of these features may be combined in ways not specifically recited in the claims and/or disclosed in the specification. Although each dependent claim listed below may directly depend on only one other claim, the disclosure includes each dependent claim in combination with every other claim in the claim set.

No element, act, or instruction used in the present application should be construed as critical or essential to the invention unless explicitly described as such outside of the preferred embodiment. Further, the phrase "based on" is intended to mean "based, at least in part, on" unless explicitly stated otherwise.

What is claimed is:

1. A sound-based flame modulation system, comprising:

a speaker tube having a first end, a second end, and a wall separating the first end and the second end;

a first speaker positioned at least partially in the speaker tube proximate to the first end and having a cone with a concave surface orientated externally from the speaker tube;

a second speaker positioned at least partially in the speaker tube proximate to the second end and having a cone with a concave surface orientated externally from the speaker tube;

a first directional tube having a proximal end and a distal end, the proximal end openly connected to the speaker tube between the first end and the wall of the speaker tube;

a second directional tube having a proximal end and a distal end, the proximal end openly connected to the speaker tube between the wall and the second end of the speaker tube;

a first plate having an opening aligned with the distal ends of the first directional tube and the second directional tube such that a passageway is formed through the first plate;

a diaphragm in a spaced apart relationship with the first plate such that an air enclosure is formed between the diaphragm and the first plate, wherein the air enclosure, the first directional tube, the second directional tube, and the speaker tube cooperate to form a static-air space such that air pressure changes in the static-air space produced by the first speaker and the second speaker move the diaphragm;

a second plate having a top, a bottom, and a plurality of through holes, in a spaced apart relationship with the diaphragm such that a gas enclosure is formed between the diaphragm and the bottom of the second plate wherein the air enclosure is isolated from the gas enclosure; and a one-way gas inlet port into the gas enclosure attachable to a source of a flammable gas;

wherein movement of the diaphragm moves flammable gas in the gas enclosure through the through holes, thereby modulating flames above the top of the second plate when the flammable gas from the through holes is ignited.

2. The sound-based flame modulation system of claim 1, further comprising an audio signals source.

3. The sound-based flame modulation system of claim 2, wherein the audio signals source is one or more of a stereo, a radio, a computer, a portable computing device, a smart phone, a portable music device, and a microphone.

4. The sound-based flame modulation system of claim 1, wherein the plurality of through holes of the second plate is more than 100 through holes.

5. The sound-based flame modulation system of claim 1, wherein the plurality of through holes of the second plate is between 1,000 and 2,000 through holes.

6. The sound-based flame modulation system of claim 1, wherein at least one of a quantity and size of the plurality of through holes of the second plate is based on a ratio of sound pressure to through hole pressure.

7. The sound-based flame modulation system of claim 1, further comprising at least one substantially vertical panel positioned proximate to the second plate.

8. The sound-based flame modulation system of claim 1, wherein at least one of the first plate and the second plate is a pan having a center portion and a lip.

9. The sound-based flame modulation system of claim 1, further comprising a housing containing the first plate, the diaphragm, and the second plate, and wherein the first plate, the diaphragm, and the second plate are substantially thermally isolated from the housing.

10. A method, comprising the steps of:

generating air pressure fluctuations in a static-air space with a first speaker positioned at least partially in the static-air space defined by a speaker tube having a first end, a second end, and a wall separating the first end and the second end, a first directional tube with a proximal end openly connected to the speaker tube between the first end and the wall, a second directional tube with a proximal end openly connected to the speaker tube between the wall and the second end, and an air enclosure defined by a first plate and a diaphragm, the first plate having an opening receiving distal ends of the first directional tube and the second directional tube, wherein the first speaker is proximate to the first end of the speaker tube and has a cone with a concave surface orientated externally from the speaker tube;

generating air pressure fluctuations in the static-air space with a second speaker positioned at least partially in the static-air space, wherein the second speaker is proximate to the second end of the speaker tube and has a cone with a concave surface orientated externally from the speaker tube;

inserting flammable gas through a one-way gas inlet port into a gas enclosure formed between the diaphragm and a second plate having a top, a bottom, and a plurality of through holes, wherein the gas enclosure is isolated from the air enclosure and the static-air space; and modulating flames above the top of the second plate by regulating flow of the flammable gas in the gas enclosure through the through holes, based on movement of the diaphragm controlled by the air pressure fluctuations in the static-air space generated by the first speaker and the second speaker.

11. The method of claim 10, wherein generating air pressure fluctuations further comprises generating audio signals from an audio signals source.

12. The method of claim 11, wherein the audio signals source is one or more of a stereo, a radio, a computer, a portable computing device, a smart phone, a portable music device, and a microphone.

13. The method of claim 10, wherein the plurality of through holes of the second plate is more than 100 through holes.

14. The method of claim 10, wherein the plurality of through holes of the second plate is between 1,000 and 2,000 through holes.

15. The method of claim 10, wherein at least one of a quantity and size of the plurality of through holes of the second plate is based on a ratio of sound pressure to through hole pressure.

16. The method of claim 10, wherein at least one of the first plate and the second plate is a pan having a center portion and a lip.

17. The method of claim 10, further comprising thermally isolating the first plate, the diaphragm, and the second plate from a housing containing the first plate, the diaphragm, and the second plate.

18. A sound-based flame modulation system, comprising:

a speaker tube having a first end and a second end;

a speaker positioned at least partially in the speaker tube proximate to the first end and having a cone with a concave surface orientated externally from the speaker tube;

a directional tube having a proximal end and a distal end, the proximal end openly connected to the speaker tube between the first end and the second end of the speaker tube;

a first plate having an opening aligned with the distal end of the directional tube such that a passageway is formed through the first plate;

a diaphragm in a spaced apart relationship with the first plate such that an air enclosure is formed between the diaphragm and the first plate, wherein the air enclosure, the directional tube, and the speaker tube cooperate to form a static-air space such that air pressure changes in the static-air space produced by the speaker move the diaphragm;

a second plate having a top, a bottom, and a plurality of through holes, in a spaced apart relationship with the diaphragm such that a gas enclosure is formed between the diaphragm and the bottom of the second plate wherein the air enclosure is isolated from the gas enclosure; and a one-way gas inlet port into the gas enclosure attachable to a source of a flammable gas;

wherein movement of the diaphragm moves flammable gas in the gas enclosure through the through holes, thereby modulating flames above the top of the second plate when the flammable gas from the through holes is ignited.

19. The sound-based flame modulation system of claim 18, wherein at least one of a quantity and size of the plurality of through holes of the second plate is based on a ratio of sound pressure to through hole pressure.

20. The sound-based flame modulation system of claim 18, further comprising one or more support positioned such that at least a portion of the diaphragm is biased toward the second plate.

* * * * *